United States Patent [19]

Nakamura et al.

[11] Patent Number: 4,848,575

[45] Date of Patent: Jul. 18, 1989

[54] RESEALABLE DISPENSER-CONTAINER FOR WET TISSUES

[75] Inventors: Kenji Nakamura; Koji Nakamura, both of Osaka, Japan

[73] Assignee: Eluci Company Inc., Hackensack, N.J.

[21] Appl. No.: 264,252

[22] Filed: Oct. 28, 1988

Related U.S. Application Data

[63] Continuation-in-part of Ser. No. 64,888, Jun. 22, 1987.

[30] Foreign Application Priority Data

Mar. 2, 1988 [JP] Japan ..... 63-49218
Apr. 18, 1988 [JP] Japan ..... 63-94791

[51] Int. Cl.[4] ..... B65D 81/24

[52] U.S. Cl. ..... 206/449; 206/607; 206/613; 206/621; 206/629; 206/813; 206/494

[58] Field of Search ..... 206/205, 613, 607, 629, 206/621, 631, 632, 633, 812, 813, 494

[56] References Cited

U.S. PATENT DOCUMENTS 4,192,420 3/1980 Worrell, Sr. et al. ..... 206/449
4,210,247 7/1980 Frye et al. ..... 206/449
4,420,080 12/1983 Nakamura ..... 206/449
4,592,840 6/1986 Brooks ..... 206/494
4,610,357 9/1986 Nakamura ..... 206/494
4,651,874 3/1987 Nakamura ..... 206/449
4,770,320 9/1988 Miles et al. ..... 206/494

*Primary Examiner*—Joseph Man-Fu Moy
*Attorney, Agent, or Firm*—Burgess, Ryan & Wayne

[57] ABSTRACT

A resealable dispenser-container for wet tissues comprises a container, made of a flexible and impervious sheet, and a tray member, made of a material harder than said container. The container contains therein wet tissues impregnated with liquid in such a manner that they can be continuously taken out, and the container has at a top surface thereof an opening for dispensing the wet tissues therethrough or a weakened line for forming the opening and a flap made of a flexible sheet material which covers the opening or weakened line and which is repeatedly opened and closed. The tray member is disposed within the container between an inner side of the top surface of the container and the wet tissues and having a recessed portion. The recessed portion has an opening formed at a bottom thereof. The tray member is fixed to the inner side of the top surface or side surface of the container.

6 Claims, 9 Drawing Sheets

RESEALABLE DISPENSER-CONTAINER FOR WET TISSUES

CROSS-REFERENCE TO RELATED APPLICATION

This application is a continuation-in-part application of patent application Ser. No. 064,888 filed on June 22, 1987.

BACKGROUND OF THE INVENTION

This invention relates to a resealable dispenser-container for wet tissues of a pop-up type wherein wet tissues are pulled out from the top of the dispenser-container.

Recently, wet tissues, i.e., fibrous materials, such as non-woven fabric, or gauze, impregnated with toilet water or cleaning solution including alcohol, moisturing agent or surfactant and so on, have been utilized widely for cleansing make-up, cleaning skin or wiping stains in a kitchen, for example, stains around a gas range or stains in a refrigerator.

In dispenser-containers for wet tissues of a pop-up type conventionally used at home, wet tissues are packed in a cylindrical container or bottle. The cylindrical container or bottle is made of a synthetic resin and is blow molded or vacuum formed. Wet tissues wound in a roll shape are contained in the cylindrical container, and the top of the container is covered by an aluminum foil when the container is sold. A cap is disposed at the top of the cylindrical container. The cap has a small aperture for dispensing wet tissues therethrough formed therein and a closure for covering the aperture attached thereto.

When wet tissues contained in such a container or bottle are used, the cap is opened first, and then the aluminum foil is removed. Then, an end of wet tissues is passed through the aperture formed in the cap. Next, the cap is again put on the cylindrical container or bottle. Thereafter, wet tissues are taken out through the aperture.

Wet tissue wound in a roll shape has a lot of perforated lines extending transversely between both the longitudinal sides of the tissue and formed equidistantly along the longitudinal direction of the tissue. When an end of tissue is upwardly taken up upon use of wet tissue, the perforated line is torn when it passes through the aperture.

If wet tissue is not torn well at the perforated line, i.e., the tissue is cut at a portion before the perforated lines pass through the aperture and, accordingly, an end of the wet tissue drops down from the aperture, it is necessary for the end of tissue to be passed again through the aperture in accordance with steps similar to those described above, after the cap is opened.

Similarly, when tissues are not taken out well because of entanglement of wet tissue while the container is used, it is necessary to open the closure and to pull wet tissue upwardly, and then, the cap is opened and an end of wet tissue is passed again through the aperture. Thereafter, steps similar to those described above have to be done.

Apart from the dispenser-container of a bottle type, dispenser-containers for wet tissues for portable use have also been conventionally known.

The conventionally known dispenser-container of wet tissues for portable use usually contains about 10 tissues and is a flat bag. The dispenser-container has an opening and a resealable flap for covering the opening. For example, the resealable flap may be made of a sheet having pressure sensitive adhesive coated on one side thereof, and the sheet is attached to the dispenser-container so that it covers the opening formed on the dispenser-container.

Another dispenser-container of a bag type has a U-shaped slit formed thereon, and the region surrounded by the slit is used as a flap while a small piece of sheet, which is larger than the flap, which has pressure sensitive adhesive coated thereon and which has an opening for dispensing the wet tissues therethrough, is attached to the portion corresponding to the above-described slit from the inside of the dispenser-container.

Such a dispenser-container of a bag type contains wet tissues, which are separated in individual pieces, and accordingly, after one tissue is dispensed, the flap is closed until the next dispensing operation wherein the flap is opened again.

Manufacturing cost of the conventionally known containers for home use wet tissues are expensive, since blow molded containers or vacuum formed containers are used.

Further, in such a dispenser-container of a pop-up type, troublesome operation is required wherein the cap is removed and an end of wet tissues is passed through the aperture when wet tissues cannot be taken out well.

Beside, when wet tissues are not taken out well and are torn, a similar operation has to be repeated. Such operation is cumbersome. Especially, several turns of the last portion of wet tissues wound in a roll shape is easily taken up in one body, and they are often torn because they cannot pass through the aperture.

Contrary to this, the above-described dispenser-containers of a bag type for wet tissues can be manufactured at a cost lower than that required for the molded containers, because the dispenser-containers can be easily made of a flexible sheet material at a high manufacturing efficiency. The dispenser-container can be easily handled when it contains a small number of wet tissues as for portable use. However, the bag type dispenser-container is not suitable as a container for home use wet tissues, which usually contains 50 to 70 tissues, because it is not easy to handle.

More specifically, the following problems are inherent in the bag type dispenser-container made of a flexible sheet, the size of which is large, or the depth of which is large, and which has a large amount of tissues contained therein, in other words, the dispenser-container has a large distance between the surface, i.e., the upper surface, having an opening, and the opposite surface, i.e., the bottom surface. Wet tissues can be smoothly dispensed, and the flap can be smoothly resealed at the beginning of use of the dispenser-container, since the shape of the dispenser-container is firmly maintained by the wet tissues filled within the dispenser-container up to the opening. However, as the wet tissues are dispensed, the wet tissues cannot be smoothly dispensed from the dispenser-container since the number of the wet tissues remaining in the dispenser-container becomes small, and it is necessary for a user of wet tissues to insert fingers deeply into the dispenser-container.

Further, when the number of the wet tissues remaining in the dispenser-container becomes small, the flap cannot be smoothly removed from or attached to the dispenser-container due to the deformation of the dispenser-container or due to the waving of the sheet of the dispenser-container at the time of opening and closing of the opening. Especially, if the dispenser-container is distorted or the surface of the dispenser-container where the flap is to be attached is waved when the flap is resealed on the dispenser-container after the flap has been opened to dispense the wet tissues, the flap cannot be firmly attached to the dispenser-container, and a small clearance may be formed between the surface of the dispenser-container and the flap. The liquid contained in the wet tissues may evaporate through the small clearance, and accordingly, there is a problem that the wet tissues are dried.

OBJECTS OF THE INVENTION

It is an object of the present invention to provide a dispenser-container for wet tissues, which can obviate the above-described problems inherent in the conventional dispenser-container for wet tissues of a bottle type or of a bag type for portable use, and wherein wet tissues can be always smoothly dispensed even if the size of the wet tissues to be contained is large or the number of the wet tissues becomes large and which can be manufactured at a low manufacturing cost.

It is another object of the present invention to provide a dispenser-container, wherein the flap can be securely opened and resealed from the beginning of use of the dispenser-container to the exhausting of the dispenser-container.

It is a further object of the present invention to provide a dispenser-container, wherein wet tissues contained therein are not easily collapsed or distorted.

It is still another object of the present invention to provide a dispenser-container, wherein the flap is prevented from waving when it is opened or closed so that the flap is securely opened or closed.

SUMMARY OF THE INVENTION

According to the present invention, the above-described objects are achieved by a resealable dispenser-container for wet tissues comprising:

a container, which is made of a flexible and impervious sheet; and a tray member, which is made of a material harder than the container;

the container containing therein wet tissues impregnated with liquid in such a manner that they can be continuously taken out;

the container having at a top surface thereof an opening for dispensing the wet tissues therethrough or a weakened line for forming the opening and a flap made of a flexible sheet material which covers the opening or weakened line and which is repeatedly opened and closed;

the tray member being disposed within the container between an inner side of the top surface of the container and the wet tissues and having a recessed portion;

the recessed portion having an opening formed at a bottom thereof; and the tray member being fixed to the inner side of the top surface or side surface of the container.

Further, according to the present invention, the above-described objects are achieved by a resealable dispenser-container for wet tissues of the above described type, wherein the tray member has a side wall hanging down from an outer periphery thereof.

In addition, according to the present invention, the above-described objects are achieved by a resealable dispenser-container for wet tissues of the above described type, which further comprises a reinforcing member attached to the flap so as to prevent the flap from waving.

The resealable dispenser-container for wet tissues of the present invention can be manufactured at a manufacturing cost lower than that required for a conventional dispenser-container of a bottle type since the container in the dispenser-container of the present invention is made of a flexible and impervious sheet.

Further, the tray member having a recessed portion is disposed within the container between the inner side of the top surface of the container and the wet tissues, and the recessed portion has the opening formed at the bottom thereof. The container contains wet tissues, which comprise a number of individual short pieces so folded that they can be continuously taken out or which are formed in a long sheet having a number of perforated lines for separating in individual pieces equidistantly formed along the longitudinal direction thereof. Accordingly, upon use, when a piece of wet tissue or a predetermined amount of wet tissues corresponding to the distance between the perforated lines is taken out, a wet tissue succeeding the taken out one is also taken out. In this case, the taken out portion of the succeeding wet tissue is held at the opening of the tray member or the recessed portion of the tray member. Therefore, even if the remaining amount of wet tissues becomes small, wet tissues can be readily taken out one by one because the end of wet tissue always protrudes into the recessed portion of the tray member, and it can be easily accessed.

In addition, according to the present invention, since the top surface of the container having an opening formed therein or the side surface of the container is fixed to the tray member, the condition of the top surface of the container is always kept at that of the beginning of its use wherein wet tissues are filled therein, regardless of the amount of the wet tissues remaining in the container.

Accordingly, a flap can always be surely opened and closed from the beginning of its use to the end of its use, even when the container contains a large amount of wet tissues and has a large thickness.

Further, when the tray member has a side wall hanging down from an outer periphery thereof, the movement of wet tissues is prevented by the side wall. Accordingly, wet tissues contained therein are not easily collapsed or distorted.

Furthermore, when a reinforcing member is attached to the flap, the flap is prevented from waving when the flap is opened or closed. Accordingly, the flap is surely attached to the top surface of the container, and the opening and closing operation becomes easy.

BRIEF DESCRIPTIONS OF THE DRAWINGS

The present invention will now be explained in detail with reference to the illustrated embodiments, wherein.

Figure 5:
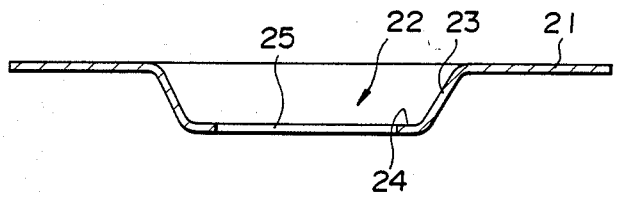
Figure 5:
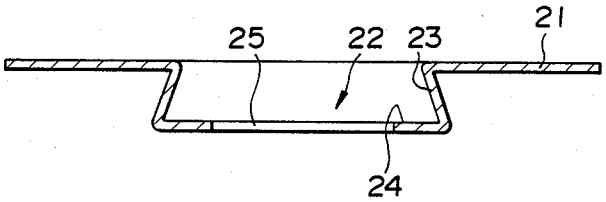
Figure 6:
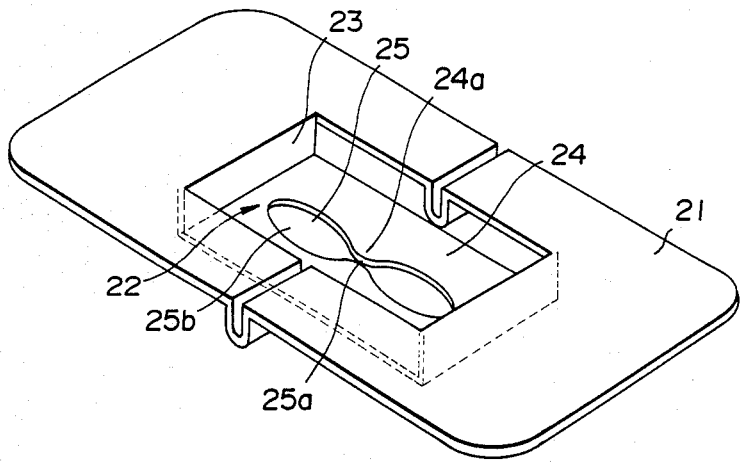
Figure 7:
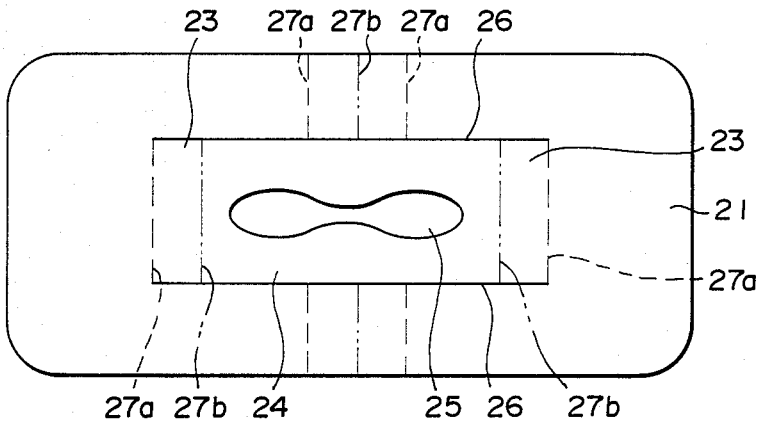
Figure 8:
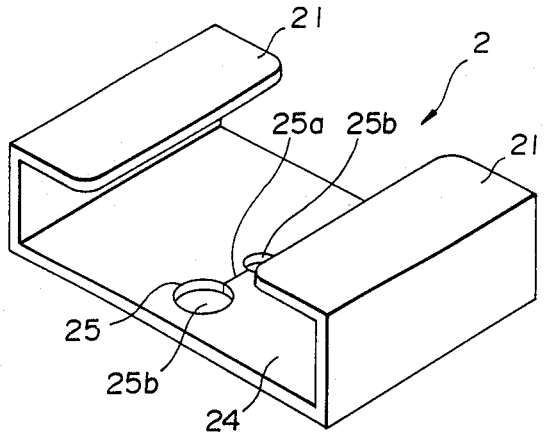
Figure 9:
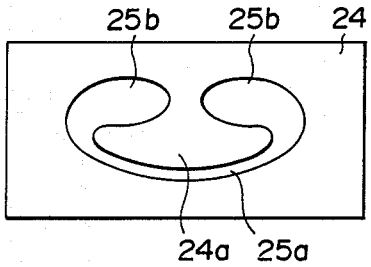
Figure 9:
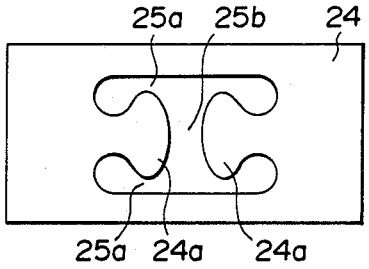
Figure 9:
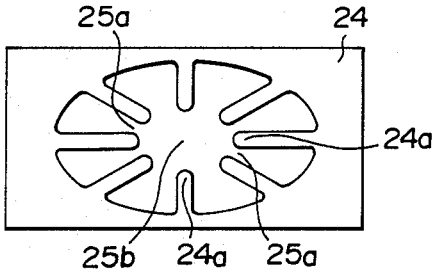
Figure 9:
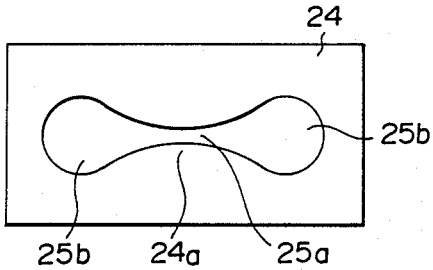
Figure 10:
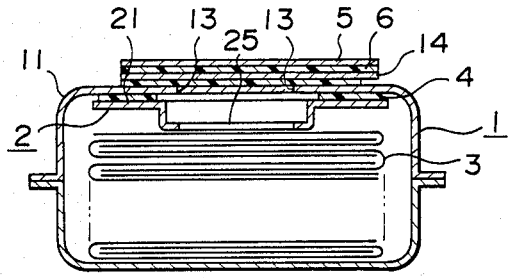
Figure 11:
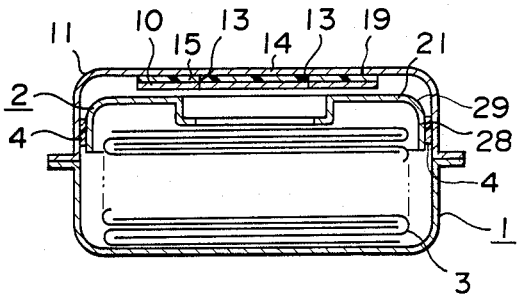
Figure 13A:
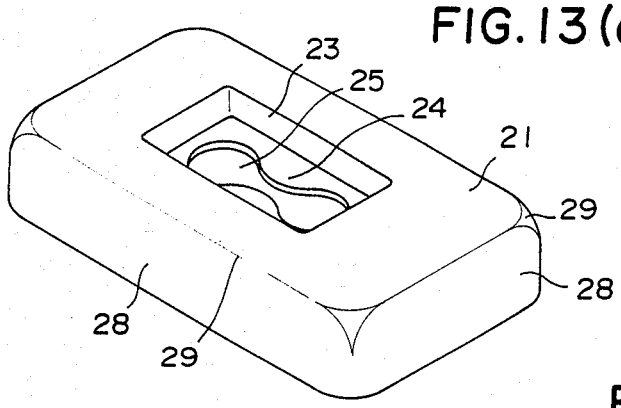
Figure 13B:
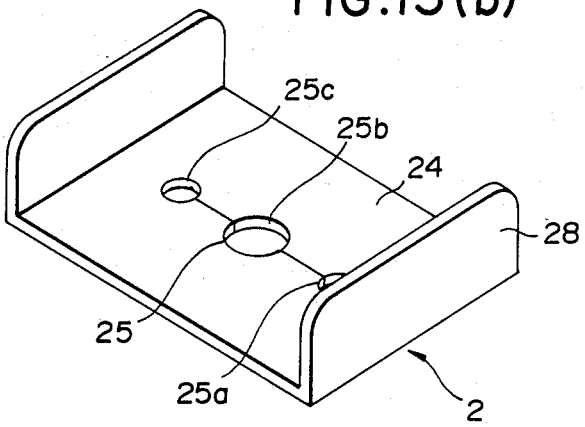
Figure 14:
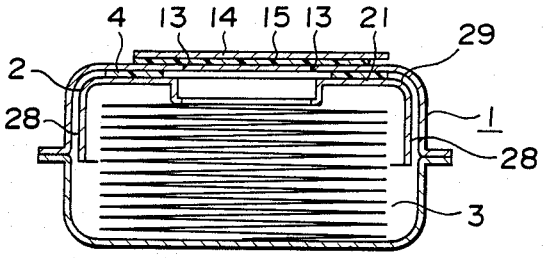
Figure 15:
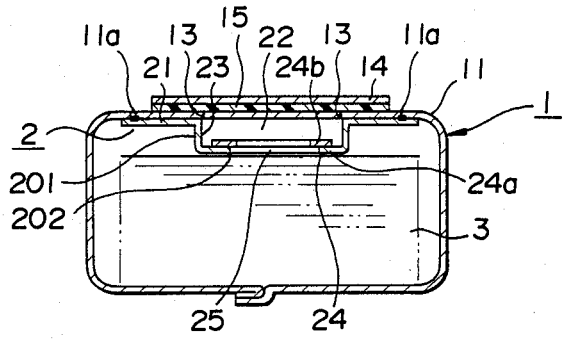
Figure 16:
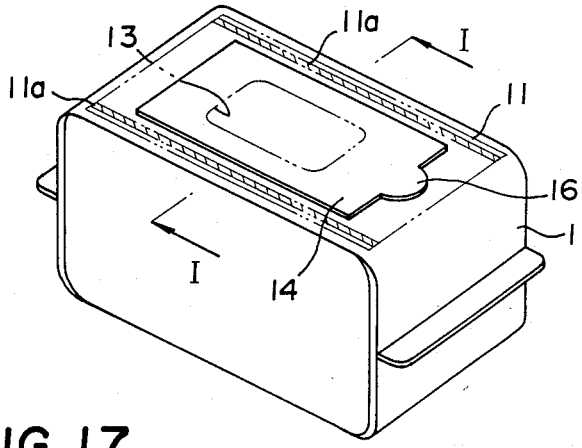
Figure 17:
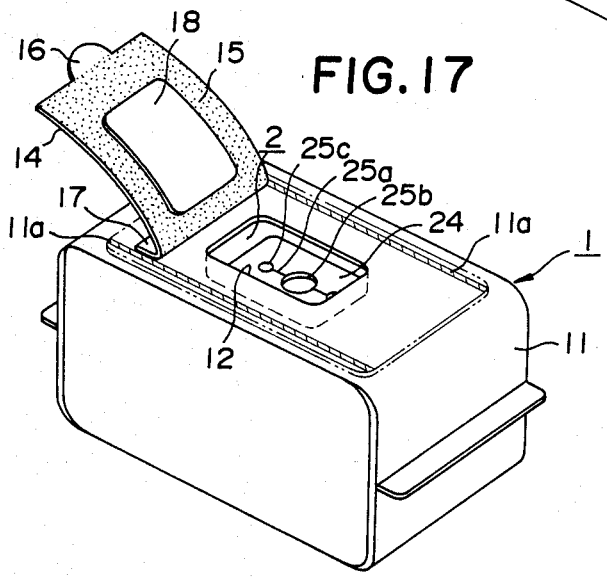
Figure 18:
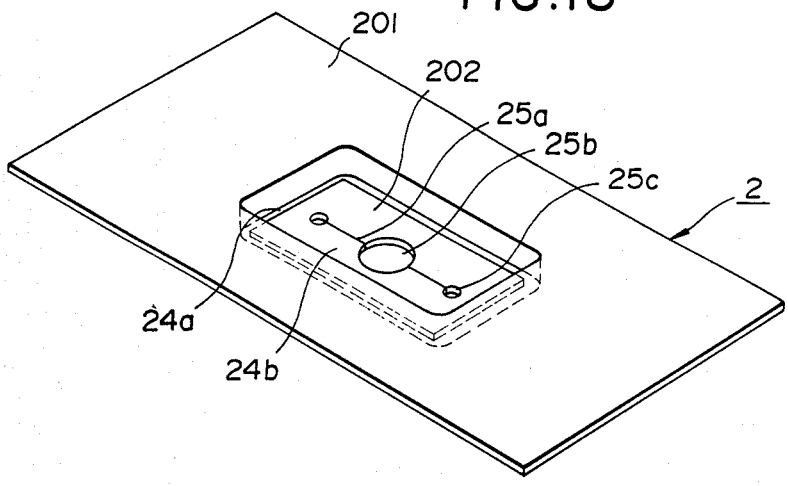
Figure 19:
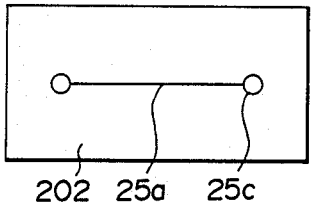
Figure 19:
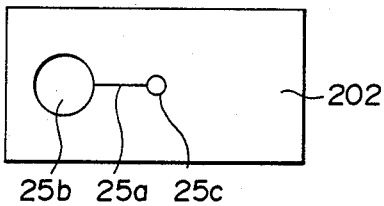
Figure 20:
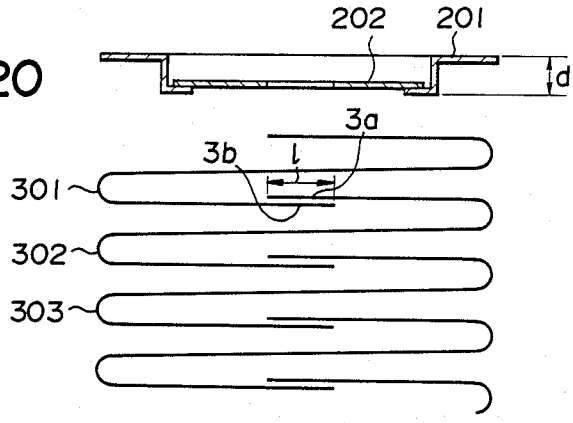
Figure 21A:
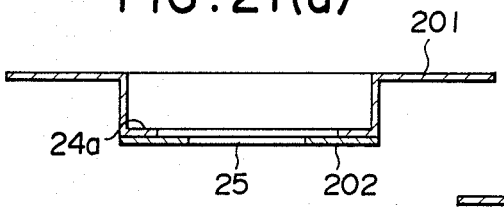
Figure 21B:
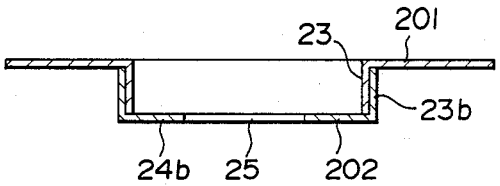
Figure 22:
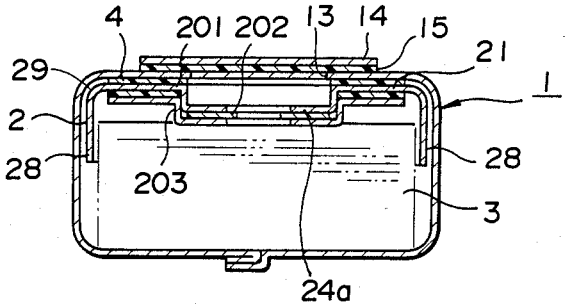
Figure 23:
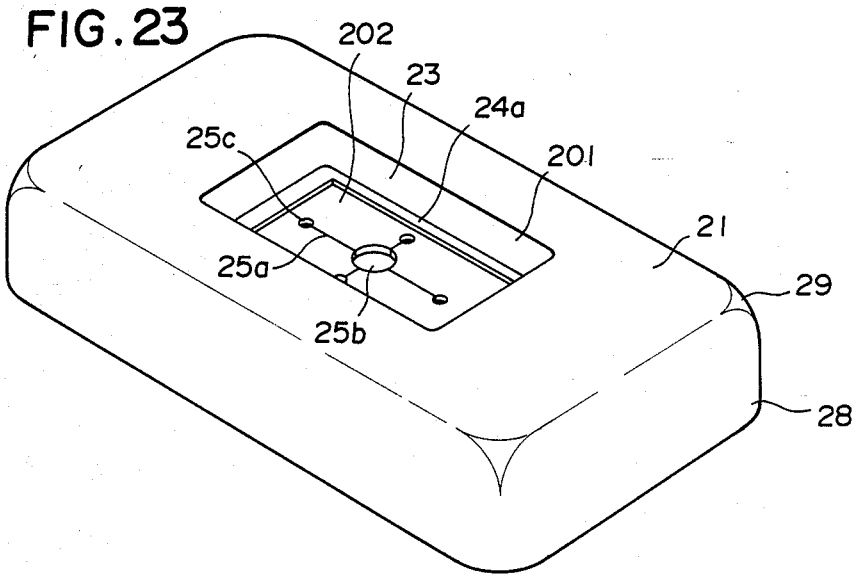

FIGS. 5 (*a*) and 5 (*b*) are cross sectional views of other embodiments of the tray member;

FIG. 6 is a perspective view of still another embodiment of the tray member;

FIG. 7 is a plan view of the embodiment illustrated in FIG. 6 wherein the embodiment is developed on a plane;

FIG. 8 is a perspective view showing another embodiment of the tray member;

FIGS. 9 (*a*) to 9 (*d*) are plan views showing various embodiments of an opening formed at a bottom surface of a tray member;

FIG. 10 is a cross sectional view of the second embodiment of the dispenser-container of the present invention;

FIG. 11 is a cross sectional view of the third embodiment of the dispenser-container of the present invention;

Fig..12 is a perspective view of the third embodiment;

FIGS. 13 (*a*) and 13 (*b*) are perspective views of tray members, respectively, which can be used in the third embodiment;

FIG. 14 is a cross sectional view of the fourth embodiment of the resealable dispenser-container for wet tissues of the present invention;

FIG. 15 is a cross sectional view taken along line I—I in FIG. 16 and showing the fifth embodiment of the resealable dispenser-container of the present invention;

FIG. 16 is a perspective view of the embodiment illustrated in FIG. 15;

FIG. 17 is a perspective view of the embodiment illustrated in FIGS. 15 and 16, wherein the flap is open;

FIG. 18 is a perspective view of the tray member which is used in the embodiment illustrated in FIGS. 15 to 17;

FIGS. 19 (*a*) and 19 (*b*) are plan views of other embodiments of an opening formed in the second member of the tray member;

FIG. 20 is a schematic cross sectional view of the tray member illustrated in FIG. 15 and the wet tissues folded and stacked one by one;

FIGS. 21 (*a*) and 21 (*b*) are cross sectional views showing other embodiments of the tray member;

FIG. 22 is a cross sectional view of another embodiment of the resealable dispenser-container of the present invention; and FIG. 23 is a perspective view of an embodiment which is used in the embodiment illustrated in FIG. 22.

DESCRIPTION OF THE PREFERRED EMBODIMENTS

Figure 1:
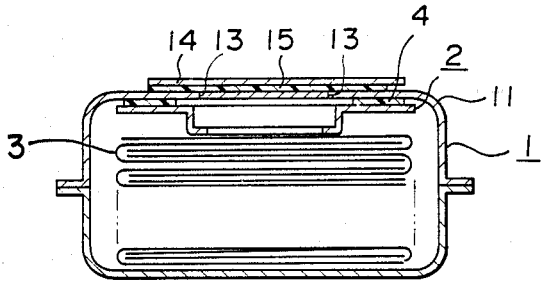
FIG. 1 is a cross sectional view of an embodiment of a dispenser-container of the present invention.
Figure 2:
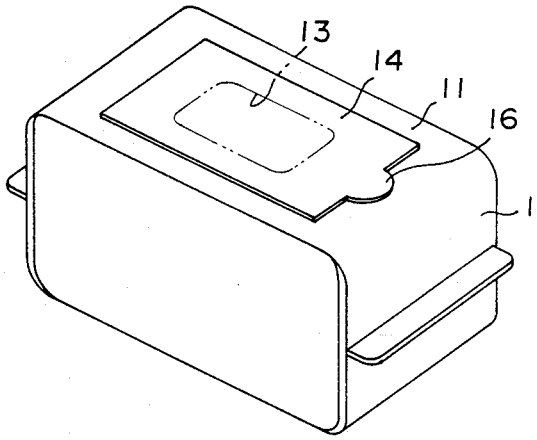
FIG. 2 is a perspective view of the embodiment illustrated in FIG. 1.
Figure 3:
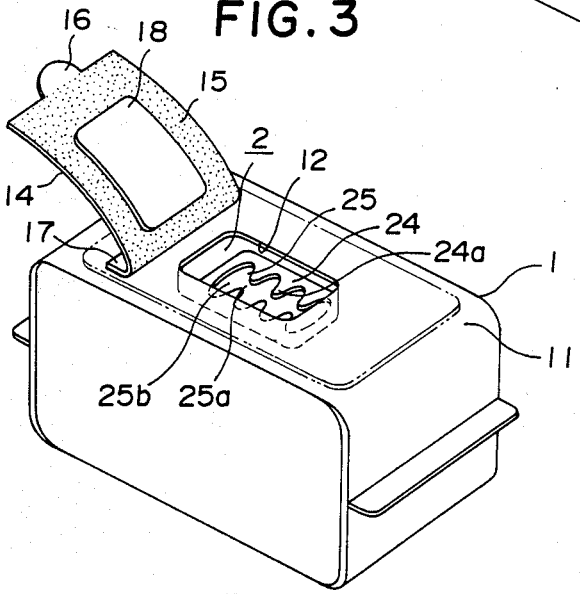
FIG. 3 is a perspective view showing the condition wherein a flap of the embodiment illustrated in FIG. 1 is open.

The first embodiment of the present invention will now be explained with reference to FIGS. 1, 2 and 3, wherein FIG. 1 is a cross sectional view of an embodiment of a resealable dispenser-container of the present invention, FIG. 2 is a perspective view of the embodiment illustrated in FIG. 1, and FIG. 3 is a perspective view showing the condition wherein a flap of the embodiment illustrated in FIG. 1 is open.

The dispenser-container for wet tissues of the present invention comprises a resealable container 1, made of flexible sheet, and a tray member 2, made of a material harder than that of the container 1 and illustrated by an imaginary line, i.e., two dot and a dash line, in FIG. 3.

In the embodiment illustrated in FIG. 1, wet tissues 3 are formed in individual pieces and are impregnated with liquid. The wet tissues are folded in accordance with conventionally known methods and are so contained in the container 1 that they can be continuously taken out.

In place of individual pieces, wet tissue which is conventionally used in a container of pop-up type, i.e., a long wet tissue having a number of perforated lines transversely extending and formed equidistantly along the length thereof may be used. In this case, the long wet tissue is folded and contained in the container so that it can be continuously taken out.

The material of the wet tissues may be, for example, fibrous material such as non-woven fabric, paper, gauze, or foam formed in a sheet. The liquid impregnated in the wet tissues may be: liquid cosmetics, such as toilet water or milky lotion; drugs, such as an antiseptic or a medicine; cleaning solution for cleaning skin, including alcohol, moisturing agent, surfactant and so on; or solution for wiping stains in a kitchen, including alcohol, agent, surfactant and so on.

The resealable container 1 has an opening 12 for dispensing the wet tissues 3 therethrough and a flap 14 for covering the opening 12 (see FIG. 3), and the construction of the container may be similar to that of the conventionally known portable dispenser-container of a bag type for wet tissues.

The flexible sheet constituting a container body 11 may be a film made of synthetic resins such as polyethylene, polypropylene, polyamide, polyester, and polyvinyl chloride, and the film may be a single layer or a laminated layer. The film may be a laminated layer of the above-mentioned film and an aluminum foil or paper. Therefore, the container body 11 is deformable.

The sheet constituting a container body 11 may be gas impervious or liquid impervious depending on the kind of the liquid impregnated in wet tissues 3, i.e., fibrous materials impregnated with liquid cosmetics or a medicine, contained in the container body 11. For example, it is preferred to use a sheet which is impervious to both gas and liquid, when perfumes which easily violates is contained in the impregnated liquid.

In the first embodiment illustrated in FIGS. 1 to 3, the flap 14 of the container 1 is a piece of a sheet which is independent from the container body 11. The material of the flap 14 may be a liquid impervious sheet which is similar to that of the container body 11. In this embodiment, both the sheet of the container body 11 and the flap 14 are liquid impervious.

The flap 14 has a pressure sensitive adhesive 15, such as polyester, acrylic or rubber adhesive, applied to one side thereof, i.e., the side contacting with container body 11, except for a grip portion 16. The flap 14 can be repeatedly adhered to and removed from the container body 11 while it covers the dispensing opening 12 formed in the container body 11 or the weakened line 13 for forming the dispensing opening 12.

It is preferred that an end 17 of the flap opposite to the grip 16 is fixed to the container body 11 by heat sealing or adhesive or that the flap 14 has slits extending from its sides so that the portion located ahead the slits is prevented from being removed.

The dispensing opening 12 formed in the container body 11 may be formed in any suitable shape, such as an ellipse, a circle, a rectangle or a rhombus. When the dispensing opening 12 is formed by a weakened line 13 (which is denoted by an imaginary line in FIG. 2), the weakened line 13 may be a perforated line when it is seen in the plan view of the container body 11 or a V-shaped slit when it is seen in a cross sectional view taken along the thickness direction of the sheet forming the container body 11. The weakened line is formed on the container body 11 to form a closed loop or an open loop such as U-shape when it is seen in the plan view of the container body 11.

When the flap 14 is opened first to use the wet tissues 3, the portion 18 surrounded by the closed loop or the open loop is removed from the container body 11 and is kept to be attached to the flap 14, and the area, from which the portion 18 is removed, becomes the dispensing opening 12.

In the embodiment illustrated in FIGS. 2 and 3, the weakened line 13 is formed on the container body 11 by a perforated line forming a closed looped ellipse. When the flap 14 is opened, the portion 18 surrounded by the closed loop is removed from the container body 11 and is kept to be attached to the pressure sensitive adhesive 15 on the flap 14, and the trace of the removed portion 18 becomes the dispensing opening 12.

As illustrated in FIG. 1, the tray member 2 is contained within the container 1 and is located between the wet tissues and the top surface of the container 1, i.e., the surface which has the dispensing opening 12 formed therein and the flap 14 attached thereto and which is opposite to the bottom surface. The size of the tray member 2 is not specifically limited, however, it is preferred that the size of the tray member 2 is almost the same as, i.e., equal to, relatively larger than or relatively smaller than, that of the folded wet tissues 3.

Figure 4:
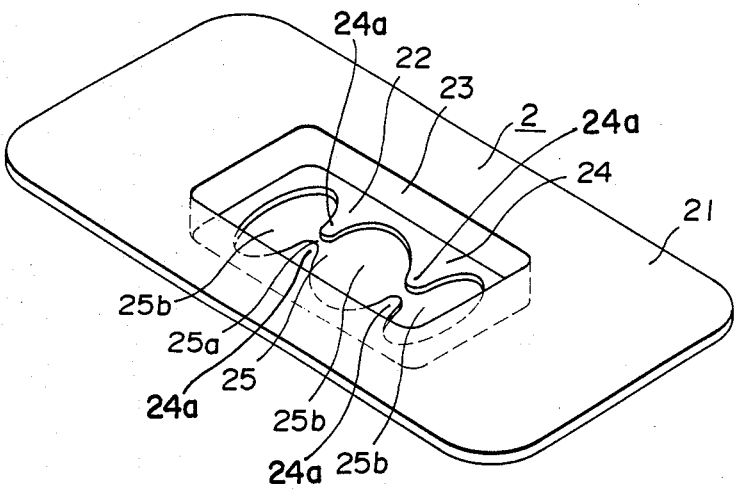
FIG. 4 is a perspective view of an embodiment of a tray member.

In the first embodiment, as illustrated in FIG. 4, the tray member 2 has a flat or substantially flat top surface 21 and a recessed portion 22 formed at almost the center of the top surface 21. The recessed portion 22 comprises side wall 23 connected to the top surface 21 and a bottom surface 24 connected to the side wall 23. The side wall 23 may surround entire peripheries of the bottom surface 24 or may connect a part of the bottom surface 24 to the top surface 21. The bottom surface 24 of the recessed portion 22 of the tray member 2 has an opening 25 formed therein which can hold the wet tissue.

In this embodiment, the top surface 21 of the tray member 2 is attached to an inner surface of the sheet constituting the container body 11 of the container 1 by means of adhesive 4 (see FIG. 1). It is preferred that hot-melt adhesive is used as said adhesive 4.

In an alternative method for fixing the tray member 2 to the container 1, heat fusible materials or materials having lamination of heat fusible material thereon may be used for the sheet material of the container 1 and the tray member 2 so that the tray member 2 is fixed to the container 1 without using any adhesive or with a small amount of adhesive. In this case, it is preferred that the same heat fusible materials are used for the container 1 and the tray member 2.

Any suitable heating method, such as a heating roller method, electronic heating, ultrasonic heating, heat sealing, may be applied to fix the tray member 2 and the container 1 by using hot-melt adhesive or heat fusible materials.

As shown in FIGS. 1 and 3, the recessed portion 22 of the tray member 2 is located just below the dispensing opening 12 of the container 1. Accordingly, when the flap 14 is opened, wet tissues 3 contained in the container 1 can be taken out from the container 1 through the opening 25 formed in the tray member 2.

In the first embodiment, the opening 25 formed in the bottom surface 24 of the tray member 2 comprises narrow portions **25*a* narrowed by the protrusions 24*a* protruding in the opening 25 and hole portions 25*b*, the size of which is so large that a pair of fingertips can be inserted therein (see FIG. 3**).

The shape, hardness, number of the protrusions **24*a* and the shape, width, number of the narrowed portions 25*a* are so selected that the amount of the wet tissues 3**, which is pulled out at one pop-up operation, may be at a desired level.

It is preferred that the protrusions **24*a* have an appropriate flexibility so that a pair of fingertips can be easily inserted through the opening 25, so that the wet tissues 3 contained in the container 1 can be smoothly picked up and so that the amount of the wet tissues 3**, which are pulled out at one pop-up operation, is at a desired level.

The next wet tissue 3 succeeding to the pulled out ones is stopped by said narrowed portion **25*a*** and is held thereby.

Further, according to the present invention, the container 1 does not have such a detachable cap as in a conventional dispenser-container of a bottle type. Therefore, the wet tissues 3 contained in the container 1 of the present invention can be accessed or handled only through the dispensing opening 12 but cannot be handled by removing a cap from the container body which is common in a conventional bottle type dispenser-container. Accordingly, in the present invention, the hole portions **25*b*, the sizes of which are large enough to enter a pair of fingertips therethrough, are formed in the opening 25 of the tray member 25 and are used to pull out the first wet tissue 3. As is apparent from the above-explanation, the remaining wet tissues 3** are successively taken out and are held by the opening if the first one is successfully taken out.

As described above, the tray member 2 is provided with the recessed portion 22 with the opening 25 and is made of material which is relatively harder than that of the container 1. The material of the tray member 2 is a synthetic resin which is formed in a sheet or foam, a relatively thin metal plate, paper coated with synthetic resin for preventing penetration of liquid, or laminated material of paper and film or an aluminum foil. The material is subjected to a suitable process, such as vacuum forming, press molding, injection molding, pressing, bending, folding or die cutting, so as to form the recessed portion 22.

Referring to FIG. 4, which is a perspective view of an embodiment of a tray member, the structure of the tray member will now be explained in detail. A tray member 2, which is similar to that illustrated in FIG. 4, is also used as the tray member 2 in the embodiment illustrated in FIGS. 1 to 3.

In this embodiment, the top surface of the tray member 2 is flat and has a recessed portion 22 formed at the center thereof. The side wall 23 of the recessed portion 22 hangs down almost vertically from the top surface 21 and surrounds entire peripheries of the bottom surface 24 so as to connect the bottom surface 24 to the top surface 21.

In the embodiment illustrated in FIG. 4, two narrow portions **25*a* are formed in the opening 25, which is formed in the bottom surface 24 of the tray member 2, by two pairs of protrusions 24*a*, protrusions 24*a* in the same pair face each other. Hole portions 25*b* are formed at the center and both the ends of the opening 25** and their size is so large that a pair of fingertips can be inserted therein.

FIGS. 5 (*a*) and 5 (*b*) are cross sectional views of other embodiments of the tray member.

In the embodiment illustrated in FIG. 5 (*a*), the side wall 23 of the recessed portion 22 inwardly inclines from the top surface 21 to the bottom surface 24. Accordingly, the recessed portion 22 diverges in a upward direction.

In the embodiment illustrated in FIG. 5 (*b*), the side wall 23 of the recessed portion 22 outwardly inclines from the top surface 21 to the bottom surface 24. Accordingly, the recessed portion 22 diverges in a downward direction, i.e., it converges in an upward direction.

FIG. 6 is a perspective view of still another embodiment of the tray member, and FIG. 7 is a plan view of the embodiment illustrated in FIG. 6 wherein the embodiment is developed on a plane.

The tray member 2 of this embodiment may be formed from a sheet-like material such as paper with a synthetic resin coating, which can be folded, as illustrated in FIG. 7. More specifically, two weakened lines 26 for separation are formed at the sides of an opening 25 along both the longitudinal sides of a sheet-like material. Creases 27*a* for folding outwardly and creases 27*b* for folding inwardly are formed around both the end portions between the weakened lines 26. Further, two sets of creases 27*a* for folding outwardly are formed between the weakened lines 26 and both the longitudinal edges of the sheet-like material. In addition, creases 27*b* for folding outwardly are formed between sets of the creases 27*a* for folding inwardly, respectively. After the weakened lines 26 are separated, the creases 27*a* and 27*b* are folded, and the tray member as illustrated in FIG. 6 is obtained.

In this tray member 2, the two side walls 23 hang down from the top surface 21 and continue to the two sides of the bottom surface 24. Accordingly, the remaining two sides of the bottom surface are not provided with the side walls.

In the tray member 2 illustrated in FIG. 8, a small aperture 25*c* is formed at the center, and a hole 25*b* having a size large enough to allow insertion of a pair of fingertips is formed at the side of the small aperture 25*c*. The small aperture 25*c* and the hole 25*b* are connected to each other by a slit-like narrowed portion 25*a*. This embodiment is suitable for a long wet tissue which has a plurality of perforated lines equidistantly formed and which is contained in the container in a folded condition. More specifically, upon start of use, a pair of fingertips are inserted into the hole 25*b* to pull out the end of the wet tissues 3. Then, the end of the wet tissues 3 is introduced to the small aperture 25*c* through the slit-like portion 25*a*. Thereafter, the wet tissues are always taken out through the small aperture 25*c* and are subjected to resistance by the small aperture 25*c*, and the wet tissues 3 are cut at the perforated lines after the perforated lines pass the small aperture 25*c*.

FIGS. 9 (*a*) to 9 (*d*) are plan views showing various embodiments of an opening 25 formed at a bottom surface 24 of a recessed portion of the tray member 2.

In the embodiment illustrated in FIG. 9 (*a*), a narrowed portion 25*a* and two relatively large hole portions 25*a* are formed by a protrusion 24*a*.

In the embodiment illustrated in FIG. 9 (*b*), four narrowed portions 25*a* are formed by two protrusions 24*a*, and a large hole portion 25*b* is also formed between the protrusions 24*a*.

In the embodiment illustrated in FIG. 9 (*c*) a number of narrowed portions 25*a* are formed by a number of protrusions 24*a*, and a large hole portion 25*b* is formed at the center of the protrusion 24*a*.

In the embodiment illustrated in FIG. 9 (*d*), a narrowed portion 25*b* and two large hole portions 25*a* are formed by two protrusions 24*a*.

The shape of the opening 25 is not limited to those illustrated in the above-explained embodiments and may be formed in any shape at will as long as it can be pulled out upon start of use and can hold the wet tissues which have been taken up.

The resealable dispenser-container for wet tissues as illustrated in FIGS. 1 to 3 is manufactured as follows by utilizing the tray member 2. First, a flexible sheet to be a container 1 having resealable flaps attached thereto, wet tissues 3 folded in such manner that they can be continuously taken out, and the tray members 2 are prepared. Preferably, the said flexible sheet is a flexible continuous sheet having resealable flaps equidistantly attached thereto.

Then, the tray member 2 is fixed to the sheet at a side opposite to that having the flaps attached thereto by means of adhesive, ultrasonic sealing, heat sealing or the like. Thereafter, the wet tissues 3 are disposed on the tray member 2. After the tray members 2 and the wet tissues 3 are wrapped with the sheet, the sheet is longitudinally and transversely sealed to form containers 1.

Alternatively, a sheet having tray members 2 fixed at one side thereof and flaps attached to the other side thereof is supplied in such a manner that the tray members 2 locate above the wet tissues. After the tray members 2 and the wet tissues 3 are wrapped with the sheet, the sheet is longitudinally and transversely sealed to form containers 1.

The resealable dispenser-containers of the present invention can be continuously manufactured according to the above-described methods.

It is also possible that the wet tissues 3 and the tray members 2 are filled in flexible containers which have been continuously manufactured by sealing three edges or by sealing one end of a tubular sheet, and then the remaining open edges of the containers are sealed to form the resealable dispenser-container of the present invention. The tray members may be fixed to the containers before or after the last sealing of the container is performed.

When the dispenser-container of the present invention which has been manufactured in the processes described above is used, the grip 16 of the flap 14 attached to the container 1 is picked up to open the flap 14. Thus, the weakened line 13 formed on the container body 11 for forming the dispensing opening 12 is removed, and the removed portion 18 is attached to the flap 14 while the portion from where the portion 18 is removed forms a dispensing opening 12, through which the uppermost wet tissue 3 is picked up by means of fingertips and the wet tissues 3 can be dispensed.

When one wet tissue 3 is taken out, a part of the succeeding tissue 3 also comes out through the opening 25. However, the latter wet tissue 3 is held by the narrowed portion 25*a* of the opening 25. Accordingly, the succeeding wet tissue 3 remains in a condition wherein only a part of the wet tissue is exposed outside. The exposed portion of the wet tissue can be contained within the recessed portion 22 of the tray member 2.

After the desired number of the wet tissues 3 are taken out, the flap 14 is closed again and is adhered to the container body 11.

Upon next usage, when the flap 14 is opened, a part of the uppermost wet tissue 3 is held in the recessed portion 22 of the tray member 2. If the end of the held wet tissue 3 is pulled, the wet tissue 3 can be readily taken out. As described above, according to the present invention, a part of the wet tissue for the next use is always kept in the recessed portion 2 of the tray member 2 after use of the resealable dispenser-container starts, i.e., the part of the wet tissue locates near the dispensing opening 12 in a condition wherein the wet tissues can be easily taken out. Accordingly, the wet tissues 3 can be readily taken out when wet tissues in the dispenser-container are consumed.

Further, according to the resealable-dispenser container of the present invention, since the tray member 2 is fixed to the top surface of the container body 11 at a position near the flap 14, the recessed portion 22 of the tray member 2 always locates near the dispensing opening 12 of the container 1 even when the remaining amount of the wet tissues 3 becomes small as the wet tissues 3 are consumed. Accordingly, the portion of the wet tissue 3, which is held by the opening 25 of the recessed portion 22, locates near the dispensing opening 12. Therefore, the wet tissues can be very easily taken out from the beginning of use to the completion of consumption regardless of the remaining amount of the wet tissues 3.

In addition, since the surface of the container body 11 near the flap 14 is fixed to the tray member 2, the surface of the container body 11 near the flap 14 is kept in a tight condition even when the amount of the wet tissues remaining in the container body 11 becomes small as the wet tissues are dispensed. Accordingly, the removal and attachment of the flap 14 to the sheet of the container body 11 can be surely performed.

The second embodiment of the present invention will now be explained referring to FIG. 10, which is a cross sectional view showing the second embodiment.

In this embodiment, similar to the embodiment illustrated in FIG. 1, the top surface 21 of the tray member 2 is fixed to the top surface of the sheet constituting the container 1 by adhesive. Further, the flap 14 has a reinforcing member 5 attached thereto by adhesive 6. Other features of this embodiment are the same as those illustrated in FIG. 1.

The reinforcing member 5 keeps the flap 14 in a tight condition and prevents the flap 14 from being waved when the flap is opened and closed.

It is preferred that the reinforcing member 5 is made of a plate which is flexible and relatively hard. Examples of the material of the reinforcing member are paperboard, a thin plastic plate or a plate of metal, such as aluminum.

The adhesive 6 is adequately selected taking into consideration the material of the reinforcing member 5 and the flap 14. For example, emulsion adhesive, solvent type adhesive, hot-melt adhesive, or pressure sensitive adhesive is suitable, which may be made of acrylic ester adhesive, polyvinyl acetate resin adhesive, polyurethane resin adhesive, silicone adhesive, epoxy polyester resin adhesive, polyamide adhesive, or polyolefin.

As described above, in this second embodiment, since the flap 14 has a reinforcing member 5 attached onto the surface thereof and is firm, the flap 14 is easily opened and closed, and a high sealing effect can be achieved.

In the second embodiment, since the top surface of the sheet constituting the container body 11 around the flap 14 is fixed to the the tray member 2, and since the flap 14 is attached to the reinforcing member 5, the sheet surface of the container body 11 around the flap 14 is kept in a tight condition, and the flap is also kept in a tight condition by the reinforcing member 5 even when the amount remaining in the container body becomes small. Accordingly, no clearance is formed between the sheet surface of the container 1 around the dispensing opening 12 and the flap 14, and the flap can be surely and repeatedly sealed. Further, opening and closing operation of the flap can be readily done.

Especially, when the reinforcing member 5 is made of a material with relatively small flexibility, the flap, to which the reinforcing member 5 is attached, becomes like a plate and behaves like a conventional closure of a synthetic resin made by injection molding. Thus, the flap 14 performs a hinge function similar to that performed by a closure made by injection molding. Accordingly, opening and closing operation can be very easily done by gripping the grip portion 16 of the flap 14.

Figure 12:
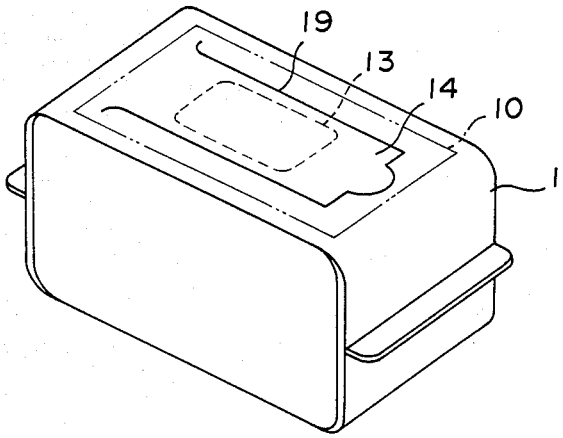

FIG. 11 is a cross sectional view of the third embodiment of the dispenser-container of the present invention, FIG. 12 is a perspective view of the third embodiment, and FIG. 13 (*a*) is a perspective view of a tray member in the third embodiment.

In this embodiment, a weakened line 19 is formed in a U-shape on a part of the container body 11 of the container 1, and the portion surrounded by the weakened line is used as a flap 14.

As illustrated in FIGS. 11 and 12, a piece of sheet 10, which is larger than the flap 14, has a weakened line 13 for forming a dispensing opening. Pressure sensitive adhesive 15 is applied to the piece of sheet 10. The piece of sheet 10 is attached by means of the pressure sensitive adhesive 15 to a portion corresponding to the weakened line 19 from the inside of the container body 11.

As illustrated in FIG. 13 (*a*), in this embodiment, the tray member 2 has side wall 28 hanging down from the peripheries thereof. The shoulder 29 connecting the side wall 28 and the top surface 21 is rounded. The side wall 28 of the tray member 2 is fixed to the sheet locating at the side of the container body 11 of the container 1 by means of adhesive 4, heat sealing and so on. Other features of this embodiment are similar to those of the above-explained first embodiment.

According to the third embodiment, since the tray member 2 has a side wall at the peripheries thereof, the upper portion of the wet tissues 3 are contained in this tray member 2, and the wet tissues 3 are prevented from changing their locations. Therefore, the wet tissues 3 are not easily collapsed or distorted while they are dispensed.

Besides, since the shoulder 29 of the tray member 2 is rounded, the entire resealable dispenser-container for wet tissues can be caught by a hand from the above.

In place of the tray member 2 illustrated in FIG. 13 (*a*), a tray member 2 illustrated in FIG. 13 (*b*) may be used. The top surface 21 in FIG. 13 (*a*) is omitted from this tray member 2.

Since the side portion of the container body 11 is fixed to the try member 2, the recessed portion 22 of the tray member 2 always locates near the dispensing opening 12 of the container 1 even when the remaining amount of the wet tissues 3 becomes small as the wet tissues 3 are consumed. Accordingly, the portion of the wet tissue 3, which is held by the opening 25 of the recessed portion 22, locates near the dispensing opening 12. Therefore, the wet tissues can be very easily taken out from the beginning of use to the completion of consumption regardless of the remaining amount of the wet tissues 3.

In addition, since the side surface of the container body 11 near the flap 14 is fixed to the tray member 2, the surface of the container body 11 near the flap 14 is kept in a tight condition even when the amount of the wet tissues remaining in the container body 11 becomes small as the wet tissues are dispensed. Accordingly, the removal and attachment of the flap 14 to the sheet of the container body 11 can be surely performed.

FIG. 14 is a cross sectional view of the fourth embodiment of the resealable dispenser-container for wet tissues of the present invention.

In this embodiment, similar to the embodiment illustrated in FIG. 1, the top surface 21 of the tray member 2 is fixed to the sheet surface of the container body 11 of the container 1 by adhesive 4. Further, similar to the tray member 2 illustrated in FIG. 13 (*a*), the tray member 2 has side wall 28 at the peripheries thereof. The depth of the side wall 28 is set larger than that illustrated in FIG. 11. A long wet tissue having a number of perforated lines is contained in the container 1. Other features of this embodiment are similar to those of the embodiment illustrated in FIG. 1.

Since the depth of the tray member 2 is set deep as described above, the shape of the container 1 is not deformed even when the reaming amount of the wet tissues becomes small. Accordingly, stacked wet tissues 3 are prevented from being collapsed or crumpled.

FIGS. 15 to 18 show the fifth embodiment of the present invention. In this embodiment, the top surface 21 of the tray member 2 is fixed to the top surface of the container body 11 constituting the container 1 in a longitudinal direction, and the fixed portions are designated by reference numeral "11*a*" in FIGS. 16 and 17.

In this embodiment, the tray member 2 has a flat or substantially flat top surface 21 and a recessed portion 22 formed at almost the center of the top surface 21. The tray member 2 comprises at least two parts, more specifically, a part of the bottom surface 24 of the recessed portion 22 is constituted by a member 202, which is different from the member 201 constituting the top surface 21.

As illustrated in FIGS. 15 and 18, in this embodiment, the first member 201 of the tray member 2 includes a top surface 21, a side wall 23 of the recessed portion 22, and a part 24*a* of the bottom surface 24 of the recessed portion 22, which part 24*a* is connected to the side wall 23. The side wall 23 may surround entire peripheries of the part 24*a* or may connect a part 24*a* of the bottom surface 24 to the top surface 21.

The second member 202 of the tray member 2 constitutes the central portion 24*b* of the bottom surface 24 of the recessed portion 22. The second member 202 of the tray member 2 has an opening 25 formed therein which can hold the wet tissue 3.

As illustrated in FIG. 15, in this embodiment, the second member 202 is disposed over the bottom part 24*a* of the surface 24 of the first member 201, and the first member 201 and the second member 202 are fixed to each other by means of a suitable adhesive, such as hot-melt adhesive, or heat fusion, such as heat sealing or the like.

FIG. 18 shows an embodiment of the tray member of the present invention. In this embodiment, the opening 25 formed in the second member 202 of the tray member 2 has a hole portion 25*b* formed at the center of the second member 202, the size of which portion is so large that a pair of fingertips can be inserted therein, two narrow slit-like portions 25*a* extending from the hole portion 25*b*, and small apertures 25*c* formed at the ends of the slit-like portions 25*a*.

The narrow slit-like portions 25*a* serve to prevent the wet tissues 3 following that being pulled out from being further taken out and hold the end of the succeeding wet tissues 3.

The shape of the opening 25 and the hardness and thickness of the second member 202 are so selected that the amount of the wet tissues 3, which is pulled out at one pop-up operation, may be at a desired level.

Since the first member 201 constituting the surface member 21 of the tray member 2 is separated from the second member 202 in this embodiment, the material, properties, such as hardness or thickness, of the first and second members can be selected at will. For example, when a relatively hard material is used for the first member 201, while a relatively soft material is used for the second member 202, wet tissues 3 can be smoothly taken out. Contrary to this, if the top surface 21 is shaped to form a rib for reinforcement or if the top surface 21 is provided with side walls at the peripheries thereof, the first member may be relatively thin, while the second member 202 is thicker or harder than the first member 201.

It is preferred that the first member 201 of the tray member 2 is made of a material somewhat harder than that of the container so that the first member also serves as a reinforcing member.

The material of the first member 201 is a synthetic resin which is formed in a sheet or foam, a relatively thin metal plate, paper coated with synthetic resin for preventing penetration of liquid, or laminated material of paper and film or an aluminum foil. The material is subjected to a suitable process, such as vacuum forming, press molding, injection molding, pressing, bending, folding or die cutting, so as to form a part of the recessed portion 22.

Similarly, the material of the second member 202 is a synthetic resin which is formed in a sheet or foam, a relatively thin metal plate, paper coated with synthetic resin for preventing penetration of liquid, or laminated material of paper and film, an aluminum foil or rubber sheet.

FIGS. 19 (*a*) and 19 (*b*) are perspective views of other embodiments of an opening 25 formed in the second member 202.

In the embodiment illustrated in FIG. 19 (*a*), a slit-like portion 25*a* and small apertures 25*c* are formed at the ends of the slit-like portion 25*a*. In this embodiment, a pair of fingertips can be inserted through the slit-like portion 25*a* if a flexible film is used as the second member 202 even when a hole having a size large enough to enter a pair of fingertips is not formed. The small apertures 25*c* formed at the ends of the slit-like portion 25*a* prevent the film from being torn when a pair of fingertips are inserted into the slit-like portions 25*a*.

In the embodiment illustrated in FIG. 19 (*b*), a small aperture 25*c* is formed at the center, and a hole 25*b* having a size large enough to allow insertion of a pair of fingertips is formed at the side of the small aperture 25*c*. The small aperture 25*c* and the hole 25*b* are connected to each other by a slit-like portion 25*a*. This embodiment is suitable for a long wet tissue which has a plurality of perforated lines equidistantly formed and which is contained in the container in a folded condition. More specifically, upon start of use, a pair of fingertips are inserted into the hole 25*b* to pull out the end of the wet tissues 3. Then, the end of the wet tissues 3 is introduced into the small aperture 25*c* through the slit-like portion 25*a*. Thereafter, the wet tissues are always taken out through the small aperture 25*c* and are subjected to resistance by the small aperture 25*c*, and the wet tissues 3 are cut at the perforated lines after the perforated lines pass the small aperture 25*c*.

The shape of the opening 25 formed in the second member 202 is not limited to those illustrated in the above-explained embodiments and may be formed in any shapes at will as long as it can be pulled out upon start of use and can hold the wet tissue which have been taken up.

FIG. 20 is a schematic cross sectional view of the tray member 2, which is illustrated in FIG. 15, and wet tissues 3, which are stacked one by one.

As illustrated in FIG. 20, the wet tissues 3 are folded in almost Z-shape and are vertically stacked. The end of neighboring wet tissues 301, 302 . . . are overlapping with each other. In this instance, as illustrated in the drawing, the front end 3*a* of the lower wet tissue 302 locates over the rear end 3*b* of the upper wet tissues 301.

Since wet tissues are moistened, the overlapping ends 3*a* and 3*b* of the neighboring wet tissues 301, 302 adhere more closely than usual dry tissues. Accordingly, when the upper wet tissue 301 is taken out, the front end 3*a* of the wet tissues 302 located just below the upper wet tissue 301 is taken out together with the rear end 3*b* of the upper wet tissue 301.

In conventional dry tissues, a large amount of the tissues are overlapped at the ends thereof so that they can be continuously taken out. According to the present invention, in order to surely contain the end 3*a* of the wet tissues which will be dispensed next time and which has been taken out with the previous wet tissue, the amount "1" of overlapping of the ends 3*a* and 3*b* of the wet tissues 3 is set about 0.3 to 4 times, preferably, 0.5 to 2 times, of the depth of the recessed portion 22.

The overlapping amount "1" is altered depending on the surface condition of wet tissues, i.e., whether or not it is rough, whether or not it has fluffs, whether or not it is smooth, and the degree of moisture.

When the surface of wet tissues is rough or has fluffs, the ends adhere closely, and accordingly, the overlapping portion may be taken out by overall length "1" into the recessed portion 22 of the tray member 2, which taken out overlapping portion is used for next pulling. Therefore, if the depth of the recessed portion 22 of the tray member 2 is, for example, 1 cm, the overlapping is set between 0.5 to 1 cm.

When the surface of wet tissues is smooth, the ends easily slip, and accordingly, a part of the overlapping portion having a length smaller than the overlapping length "1" may be taken out into the recessed portion 22 of the tray member 2, which taken out part is used for next pulling. Therefore, it is preferred that the overlapping length "1" is set larger than the depth of the recessed portion, for example, 1.5 to 4.0 times of the depth.

The length of the end 3*a*, which is gripped by fingers at the next dispensing operation, is so set taking into consideration the depth and the width of the recessed portion 24 of the tray member 2 that the end 3*a* can be readily gripped by fingertips and that the flap 14 can be easily closed. If the length of the end 3*a* is too short, it is very difficult for a consumer of wet tissues to grip the end. Accordingly, it is preferred that the length is set to be longer than 0.3 cm, preferably more than 0.5 cm.

When the fifth embodiment of resealable dispenser-container illustrated in FIGS. 15 to 18 is manufactured by utilizing the above-described tray member 2, a flexible sheet to be a container 1 having resealable flaps attached thereto, preferably, a flexible continuous sheet having resealable flaps equidistantly attached thereto, wet tissues 3 folded in such manner that they can be continuously taken out, an the tray members 2 comprising the first member 201 and the second member 202 are prepared first.

Then, the tray member 2 is disposed on the sheet at a side opposite to that having the flaps attached thereto and is heated by means of an appropriate heating means, such as a heating roller, so as to melt the sheet and the tray member 2 and to fix them to each other.

Thereafter, the wet tissues 3 are disposed on the tray members 2. After the tray members 2 and the wet tissues 3 are wrapped with the sheet, the sheet is longitudinally and transversely sealed to form containers 1.

Alternatively, a sheet having tray members 2 fixed at one side thereof and flaps attached to the other side thereof is supplied in such a manner that the flaps are disposed at the outer surface. After the tray members 2 and the wet tissues 3 are wrapped with the sheet, the sheet is longitudinally and transversely sealed to form containers 1.

The resealable dispenser-containers of the present invention can be continuously manufactured according to the above-described methods.

When the dispenser-container of the present invention which has been manufactured in the processes described above is used, the grip 16 of the flap 14 attached to the container 1 is picked up to open the flap 14. Thus, the weakened line 13 formed on the container body 11 for forming the dispensing opening 12 is removed, and the removed portion 18 is attached to the flap 14 while the portion from where the portion 18 is removed forms a dispensing opening 12, through which the uppermost wet tissue 3 is picked up through the opening 25 formed in the second member 202 of the tray member 2 by means of fingertips and the wet tissues 3 can be dispensed.

When one wet tissue 3 is taken out, a part of the succeeding tissue 3 also comes out through the opening 25. However, the latter wet tissue 3 is held by the narrowed portion 25*a* of the opening 25. Accordingly, the succeeding wet tissue 3 remains in a condition wherein only a part of the wet tissue is exposed outside. The exposed portion of the wet tissue can be contained within the recessed portion 22 of the tray member 2.

After the desired number of the wet tissues 3 are taken out, the flap 14 is closed again and is adhered to the container body 11.

Upon next usage, when the flap 14 is opened, a part of the uppermost wet tissue 3 is held in the recessed portion 22 of the tray member 2. If the end of the held wet tissue 3 is pulled, the wet tissue 3 can be readily taken out.

Since the tray member 2 according to the present invention is fixed to the container body 11 as described above, the recessed portion of the tray member locates near the dispensing opening 12 even when the remaining amount of the wet tissues in the dispenser-container becomes small as wet tissues are consumed. Further, a part of the wet tissues is always kept in the recessed portion 22 of the tray member 2 after start of use of the resealable dispenser-container. Accordingly, the part of the wet tissue 3 locates near the dispensing opening 12 and can be readily taken out when wet tissues in the dispenser-container are consumed.

Further, according to the resealable-dispenser container of the present invention, since the top surface of the tray member 2, which surface is harder than the container body, is located below and fixed to the top surface of the container body 11 at a position near the flap 14, the sheet surface of the container body 11 near the flap 14 is kept in a tight condition even when the remaining amount of the wet tissues 3 becomes small as the wet tissues 3 are consumed. Accordingly, the removal and attachment of the flap 14 to the sheet of the container body 11 can be surely performed.

FIGS. 21 (*a*) and 21 (*b*) are cross sectional views showing other embodiments of tray members.

The embodiment illustrated in FIG. 21 (*a*) is different from that illustrated in FIG. 15 in that the second member 202 of the tray member 2 locates below the bottom surface 24*a* of the first member 201, and the other structures are the same as those of the tray member 2 illustrated in FIG. 15.

In the embodiment illustrated in FIG. 21 (*b*), the first member 201 is provided with the top surface 21 and the side wall 23, while the second member 202 is provided with the bottom surface 24*b* with an opening 25 and side wall 23*b* connected thereto. The first member 201 and the second member 202 are fixed to each other at the side walls 23 and 23*b*.

FIG. 22 is a cross sectional view of another embodiment of the resealable dispenser-container of the present invention, and FIG. 23 is a perspective view of the tray member utilized in this embodiment.

In this embodiment, the top surface 21 of the tray member 2 is attached to the sheet surface of the container body 11 of the container by means of adhesive 4. The tray member 2 comprises three members 201, 202 and 203.

As illustrated in FIGS. 22 and 23, the first member 201 of the tray member 2 is provided with a side wall 28 hanging down from the outer peripheries thereof. The shoulder portion 29 connecting the side wall 28 and the top surface 21 is rounded. The other structures of the first member 201 are almost the same as those of the fifth embodiment illustrated in FIG. 15.

The second member 202 of the tray member 2 is formed in a flat plate shape and locates below the bottom surface 24*a* of the first member 201. As clearly illustrated in FIG. 23, the second member 202 has an opening 25, which comprises a hole portion 25*b* formed at the center of the second member 202, size of which portion is so large that a pair of fingertips can be inserted therein, four narrow slit-like portions 25*a* extending from the hole portion 25*b* in the four directions, and small apertures 25*c* formed at the ends of the slit-like portions 25*a*.

The third member 203 of the tray member 2 has a shape similar to that of the first member 201 but does not have any side wall at the periphery thereof. The third member 203 locates below the second member 202 and is fixed to the first member 201 so as to sandwich the second member 202 therebetween. The third member 203 serves to reinforce the first member 201.

According to this embodiment, since the first member 201 of the tray member 2 is provided with side walls 28 at the peripheries thereof and since the recessed portion is also provided with side walls, the strength of the first member 201 can be high even if the thickness of the first member is thin. Further, since the first member 201 and the third member 203 are fixed to each other and strengthen each other, the thickness of the first member 201 and the third member 203 can be small. Contrary to this, the second member 202 is merely sandwiched between the first member 201 and the third member 203, the hardness and thickness of the second member can be selected at will.

Further, according to this embodiment, the first member of the tray member 2 has side walls formed at the peripheries thereof. The wet tissues 3 located upper portion are contained in this tray member 2. Accordingly, the wet tissues 3 are prevented from being moved or deformed while they are dispensed.

In addition, since the shoulder 29 of the tray member 2 is rounded, the whole dispenser-container for wet tissues can be held from the above.

Although the resealable flaps 14 are adhered to the sheet surfaces of the containers by means of pressure sensitive adhesive 15 in the above-described embodiments, the flap 14 may be resealably attached to the sheet surface by means of magnetic force in place of or in combination with the pressure sensitive adhesive 15.

More specifically, either one of the flap and the portion of the container body around the dispensing opening (in some cases, entire regions of the container body) is magnetized, and the other member has a property to be attracted by the magnetic force. Further, it is possible to magnetize or apply a property to be attracted by the magnetic force to the reinforcing member instead of the flap, or to the tray member 2 in place of the portion around the dispensing opening. If the latter structures are adopted, the flap or the reinforcing member and the container body or the tray member are attracted to each other by means of the magnetic force, and the dispenser-container can be hermetically sealed.

In order to apply a property to be attracted by magnetic force to the container body or flap, thermoplastic synthetic resin and ferromagnetic powder may be mixed together to form a sheet material, ferromagnetic powder may be coated on flaps or portions around dispensing openings, or a sheet material having ferromagnetism may be laminated.

Further, in order to magnetize the container body or flap, thermoplastic synthetic resin and magnetic powder may be mixed together to form a sheet material, magnetic powder may be coated on flaps or portions around dispensing openings, or a sheet material having magnetism may be laminated.

Besides, if the reinforcing member or the tray member is made of a metal or is magnetized, magnetism can be easily applied thereto.

Advantages of the Invention

Since the container in the dispenser-container of the present invention is made of a flexible and impervious sheet, the resealable dispenser-container of the present invention can be manufactured by manufacturing steps with high production efficiency compared with the conventional containers of a bottle type which are made by blow molding or vacuum forming, and the cost of the raw material for the container of the present invention is low. Accordingly, the resealable dispenser-container for wet tissues of the present invention can be economically manufactured.

Further, the tray member having a recessed portion is disposed within the container between the inner side of the top surface of the container and the wet tissues, and the recessed portion has the opening formed at the bottom thereof. The container contains wet tissues. The wet tissues may comprise a number of individual short pieces so folded that they can be continuously taken out. The wet tissues may be formed in a long sheet having a number of perforated lines for separating in individual wet tissue pieces equidistantly formed along the longitudinal direction thereof. Accordingly, upon use, when a piece of wet tissue or a predetermined amount of wet tissues corresponding to the distance between the perforated lines is taken out, a wet tissue succeeding the taken out one is also taken out. Therefore, even if the remaining amount of wet tissues becomes small, wet tissues can be readily taken out one by one when the end of wet tissue protruding into the recessed portion of the tray member is pulled out.

In addition, according to the present invention, since the top surface of the container having an opening formed therein or the side surface of the container is attached to the tray member, the condition of the portion around the opening is always kept at that of the beginning of its use wherein wet tissues are filled therein, regardless of the amount of the wet tissues remaining in the container.

Accordingly, a flap can always be surely opened and closed from the beginning of its use to the end of its use, even when the container contains a large amount of wet tissues and has a large thickness.

Furthermore, when a reinforcing member is attached to the flap, the flap is prevented from waving when the flap is opened or closed. Accordingly, the flap is surely attached to the top surface of the container, and the opening and closing operation becomes easy.

Still further, when the tray member has a side wall hanging down from an outer periphery thereof, the movement of wet tissues is prevented by the side wall. Accordingly, wet tissues contained therein are not easily collapsed or distorted.

When the tray member of the present invention comprises different members, i.e., a top surface and at least a part of a bottom surface of a recessed portion, appropriate materials for the top surface and the bottom surface with opening of the recessed portion can be selected taking into consideration the purposes thereof.

What is claimed is:

1. A resealable dispenser-container for wet tissues comprising:

a container, which is made of a flexible and impervious sheet; and a tray member, which is made of a material harder than said container;

said container containing therein wet tissues impregnated with liquid in such a manner that they can be continuously taken out;

said container having at a top surface thereof an opening for dispensing said wet tissues therethrough or a weakened line for forming said opening and a flap made of a flexible sheet material which covers said opening or weakened line and which is repeatedly opened and closed;

said tray member being disposed within said container between an inner side of said top surface of said container and said wet tissues and having a recessed portion;

said recessed portion having an opening formed at a bottom thereof; and said tray member being fixed to said inner side of said top surface or side surface of said container.

2. A resealable dispenser-container for wet tissues according to claim 1, wherein said opening formed at said bottom of said tray member is capable of holding wet tissue.

3. A resealable dispenser-container for wet tissues according to claim 1 or 2, wherein said tray member has a side wall hanging down from an outer periphery thereof.

4. A resealable dispenser-container for wet tissues according to claim 1 or 2, which further comprises a reinforcing member attached to said flap so as to prevent said flap from waving.

5. A resealable dispenser-container for wet tissues according to claim 1 wherein said tray member is composed of at least two different members, one of which members constitutes said top surface and another of which members constitutes at least a part of said bottom of said recessed portion of said tray member has said opening for holding said wet tissues.

6. A resealable dispenser-container for wet tissues according to claim 1, wherein said contained wet tissues comprise individual pieces, each of which is folded in a Z-shape and adjacent ends of which are overlapping with each other, and a degree of said overlapping is 0.5 to 4 times of a depth of said recessed portion.

* * * * *